US005765314A

United States Patent [19]

Giglio et al.

[11] Patent Number: 5,765,314

[45] Date of Patent: Jun. 16, 1998

[54] SENSORY INTERACTIVE MULTI MEDIA ENTERTAINMENT THEATER

[76] Inventors: Vincent S. Giglio, 130 Westview Commons; Vincent J. Mancuso, 100 Emerald Point, both of Rochester, N.Y. 14624

[21] Appl. No.: 720,879

[22] Filed: Oct. 3, 1996

[51] Int. Cl.[6] ..... E04H 3/26

[52] U.S. Cl. ..... 52/7; 52/10; 472/75

[58] Field of Search ..... 52/6–10; D25/7, D25/9, 12, 17, 19, 31; 472/60, 61, 75, 59

[56] References Cited

U.S. PATENT DOCUMENTS

| | | |
|---|---|---|
| 1,482,701 | 2/1924 | Rigaumont . |
| 1,517,774 | 12/1924 | Duprey . |
| 2,700,798 | 2/1955 | Perrottet . |
| 3,263,380 | 8/1966 | Bourbonnais . |
| 3,394,505 | 7/1968 | Rife . |
| 3,399,501 | 9/1968 | Rossman . |
| 4,854,092 | 8/1989 | Chatenay epouse . |
| 4,885,878 | 12/1989 | Wuu . |
| 4,962,420 | 10/1990 | Judenich . |
| 5,319,895 | 6/1994 | Ray . |
| 5,433,670 | 7/1995 | Trumbull . |

*Primary Examiner*—Christopher Kent
*Assistant Examiner*—Yvonne Horton-Richardson
*Attorney, Agent, or Firm*—Cumpston & Shaw

[57] ABSTRACT

This invention relates to a sensory interactive multi media entertainment theater for presenting innovative, sensory oriented interactive productions combining live theater and motion picture technology in a 360° visual effects theater building. The present invention relates to a theater comprising a circular arena having a 360 degree media surface and tiered seating on preferably hydraulic platforms that can be raised or lowered automatically. Seats may rotate by sections and follow the action of the show to ensure that the audience witnesses every aspect of the production. The individual seats may rotate via automated control and preferably include surround-sound speakers built into the headrests. Appliances built into the seats, armrests and nearby flooring can create a changing thematic environment to complete the sensory experience. A center stage along with stage runners may be hydraulically raised or lowered depending upon the production.

20 Claims, 7 Drawing Sheets

SENSORY INTERACTIVE MULTI MEDIA ENTERTAINMENT THEATER

FIELD OF THE INVENTION

This invention relates to a sensory interactive multi media entertainment theater for presenting innovative, sensory oriented interactive productions combining live theater and motion picture technology in a 360° visual effects theater building.

BACKGROUND OF THE INVENTION

In the construction of theaters it has long been the practice to provide stationary seats facing a single stage area. Traditionally, rows of seats have been placed such that those nearest the stage are at the lowest elevation and the rows are placed at progressively higher elevations towards the rear of the theater, thus making it possible for those seated towards the rear to see over those seated in front. Although this arrangement has been in use for a very long time, it has numerous disadvantages, for most of which is that generally only a single stage area is provided. This usually requires a substantial break during a production while the scenery is hastily changed. This also often places practical limits on the number of scenery changes that can be made during a production. The traditional seating arrangements have the additional disadvantage in that seats in the rear of the auditorium are far from the stage and, thus, usually must be sold at a lower price than those closer to the stage.

Some attempts have been made to overcome these disadvantages. For example, the theater in the round has a central stage area in which the audience surrounds the stage 360°. The obvious disadvantage of this set up is that the players on the stage can only face one section of the audience at a time. Another example has been shown to have one or more rotatable platforms that were used to move persons past a stationary centrally located viewing area. This, however, has the disadvantage in that the attention of the entire viewing audience can not be focused on one area at one time. Another attempt at improving the traditional theater construction is a stage partly surrounding a rotary house, however, the surface of these stages intended for the performance is interrupted by partitions so that the performance cannot continuously develop in one direction and the problems of how to deal with curtains has not been solved.

Presently, most movie theaters are conventional and remain much the same as they have been for the last 40 or 50 years. Improvements have been made in the sound systems and also in the projection equipment used to show the movie. There have been occasional attempts to provide a greater feeling of reality to the viewer. Some of these systems have utilized wider screens and special movie making cameras and movie projectors. Other systems have addressed the sound systems and attempted to place the viewet in the middle of the sound that would be observed by the viewer if he were in the scenes of the movie. Another attempt has been to tap the viewer's sense of smell by providing the viewer with a card which would be scratched at different times during the movie to produce smells that would be recognized. Some theaters have even been designed to project the movie on the ceiling of the theater and they place the viewer in seats that are oriented towards the ceiling. Other theaters have even installed mechanical structures for vibrating the seats to provide additional realism. Another attempted improvement of the typical movie theater is a building for the theater which would have a dome like spherical configuration that is formed of geodesic triangular panels. The inner wall surface of the building would function as a curved motion picture screen surface and provide at least a 300° arc for projecting the movie thereupon.

One attempt at providing realism in cinemas is the advent of simulators. Simulators are well known in the art having found applications in such diverse fields of air craft pilot training and amusement rides. In general, known simulators include a motion base having one or more seats and a plurality of programmable actuators which displace the motion base from a rest position in accordance with the predetermined sequence of drive signals. Synchronized with the motion base movement is a motion picture illuminated on a projection screen directly attached to the motion base or in the immediate environment. A controller is sometimes included to provide for the synchronization between the motion base displacements and the accompanying audio visual work. Alternatively, the audio visual images in motion base control signals are simultaneously recorded in media if, for example, the resulting program is to be repeatedly used. With known simulators the movement imparted by the motion base has been correlated with the presentation of visual images without regard to the physiological effect on passengers on that combination of image in motion. An unanticipated and unwanted consequence is the frequent inducement of motion sickness. It has been recognized that motion sickness stems primarily from an improper relationship between visual images and a corresponding motion of a person's reference frame. In addition, many of these simulators require seat belts, harnesses, and helmets in order to protect the viewing audience from injury.

The disadvantages of these movie houses, theater buildings, and simulators is that none of them have been able to successfully combine cinematography with theatrical performances involving live actors and actresses. Furthermore, the great majority of these buildings have not been provided with seats which are moveable towards the action shown on either the cinema screens or the theater stages.

It would be desirable to provide a theater building able to produces novel panoramic effects based on the unidirectional flow of reproduction. It would also be desirable to provide a novel movie theater that upgrades or creates a greater feeling of reality to the cinema patron. It would also be desirable to provide moveable seats which generate a realistic simulation of an event in combination with the theater and cinema portion of the theater building, capable of installation in a standard, stable building while avoiding movement that has the potential for inducing motion sickness or requiring seat belts and helmets. To date, these objects have not been accomplished in a single theatrical building.

SUMMARY OF THE INVENTION

The Sensory Interactive Multimedia Environment Theater (the SIME™ Theater) is a circular arena with tiered seating on preferably hydraulic platforms that can be raised or lowered automatically. Seats may rotate by sections and follow the action of the show to ensure that the audience witnesses every aspect of the production. The individual seats, or "Immersion Pods" seats, rotate via automated control and preferably include surround-sound speakers built into the headrests. Appliances built into the pods, armrests and nearby flooring can create a changing thematic environment to complete the sensory experience.

There is preferably a traditional, fully functional main stage which is connected at the front of an encompassing perimeter stage that encircles the seated audience. The entire 360° of perimeter stage performance area is preferably draped with front/rear projection media surfaces to create a "CineTheater" of seamless transition between reality and fantasy. These media surfaces that encircle the theater allow for talent and props to pass back and forth into the film domain, live characters to interact with film images, or conceal upcoming effects or curtain additional stages while images are projected on them. Scenic elements can be lifted up from below the perimeter stage to create, in conjunction with the media surfaces, a truly 3-D depth of field and perspective. A selected number of smaller, fully equipped satellite stages may be incorporated into the perimeter stage at several locations around the audience for additional set design and performance area.

A round hub stage is located in the center of the theater. It is preferably comprised of an inner core encircled by an outer ring that each have independent access and hydraulic control for height and rotation. Runner stages ("runners") cross the audience from preferably four points on the perimeter stage and converge at the hub stage. The runners may be hydraulically controlled to raise and lower as tiers or slopes during the performance in precise relation to the audience seating platforms.

Besides traditional grid and truss systems above each stage area, a theatrical canopy located over the audience may accommodate an intricate series of special effects and set designs that envelop the audience in total atmosphere and provide the mechanical structure for incredible effects and illusions. Extensive lighting, laser, hologram, film projection, live image magnification, pyrotechnics and climate control are able to be innovatively incorporated into the structure adding to the unparalleled production capabilities of the arena.

Thus, the SIME™ Theater allows a production crew to create family oriented, action-based sensory experiences that surpass any form of virtual technology and/or entertainment. No goggles, gloves, nor helmets are required, just a patron's own eyes and ears (along with other senses) are needed to experience an unbelievable, live production. These new innovative productions, or Technatractions™ productions, can be complete with full choreographed production numbers and original music. In its fullest form, a Technatraction™ production incorporates live theater with grand-scale illusions, film and television projection, special effects, animatronics, atmospheric enhancements, laser/light/surround sound, and an interactive seating design. Thus, a Technatraction™ production shown in the theater building according to the present invention will exhilarate and adrenalize the audience to their optimum through the stimulation of their senses, the 360° panorama of the production, and the sheer scope of the incredible illusions that they will witness.

DETAILED DESCRIPTION OF THE INVENTION

Figure 1:
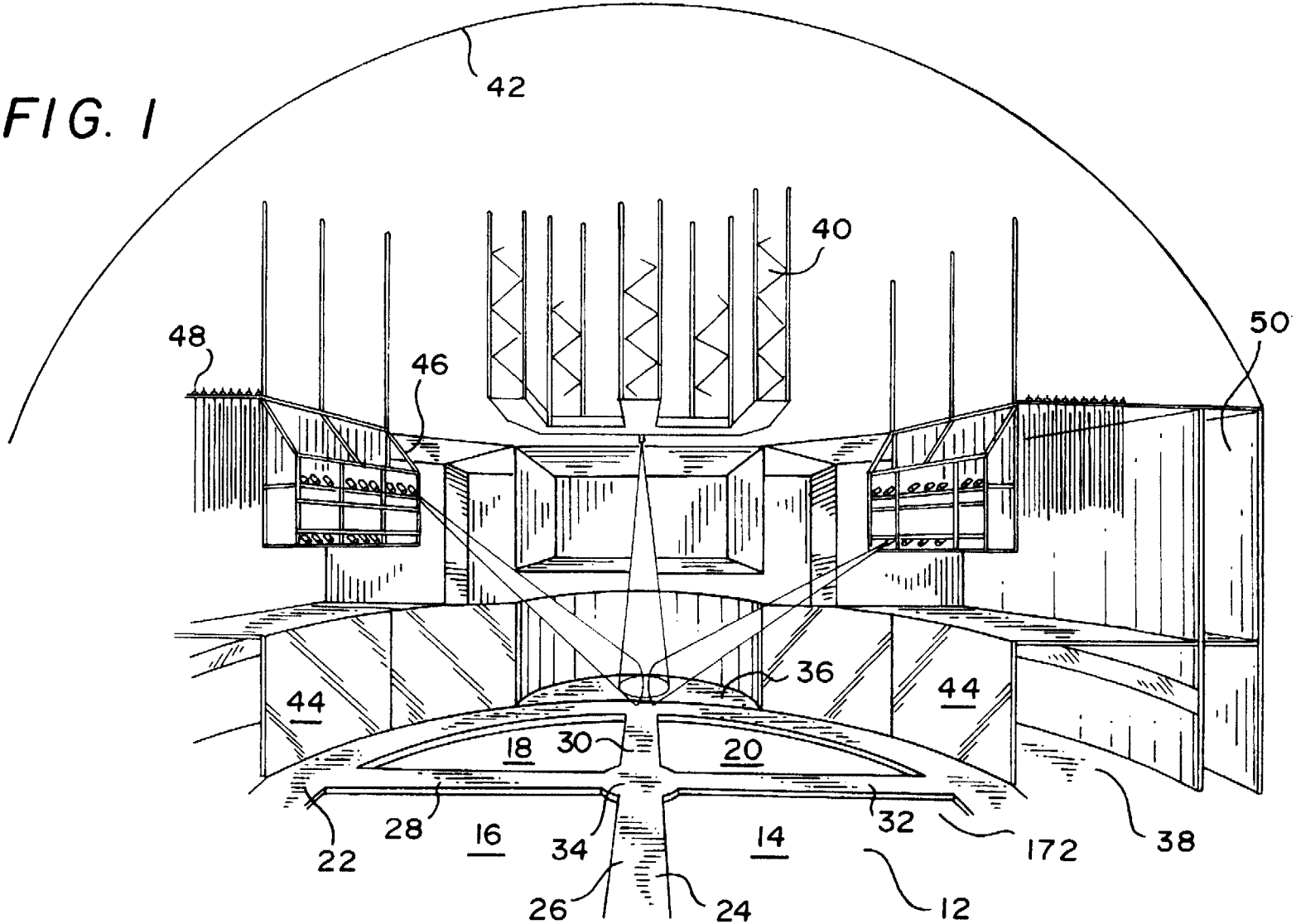
FIG. 1 is a perspective view of the front interior portion of the theater of the present invention showing the main stage, the hub stage, and in part the runner stages and the perimeter stages.

Turning to FIG. 1, a perspective view of the front interior portion of theater building 10 is shown. A plurality of seating areas 12 are located as shown on theater floor 172. The seating areas 12 are divided into different sections 14, 16, 18, and 20 which each provide ample seating for the theater. Of course, it is within the scope of this invention to provide more or less sections. The seating areas 12 accommodate seats which will be further described below. Surrounding the seating areas 12 is a perimeter stage 22 which encompasses the entire perimeter of the seating areas 12 and enables a panoramic theater production. Because the perimeter stage 22 is continuous throughout the entire theater, continuous action involving live theater performers is able to take place at any point 360° within the theater. The theater building 10 is also preferably provided with a hub stage 34 in the center of the theater. The hub stage 34 can accommodate live performances in a central area amidst the seating area 12. Connecting the hub stage 34 and the perimeter stage 22 are a number of runner stages 24. Preferably, there are four runner stages 26, 28, 30, and 32 which divide the seating area 12 into quadrants, or sections 14, 16, 18, and 20. Again, it is within the scope of this invention to provide more or less runner stages 24 to divide the seating area 12 into more or less sections. The runner stages 24 are hydraulically controlled to be either tiered or planar. Adjacent one section of the perimeter stage 22 and in front of runner stage 30, is a traditional main stage 36. The main stage 36 is a large traditional performance area with separate lights and a separate grid and truss system. The main stage 36 has two media surfaces 44 further described below that can open and close horizontally as curtains. Also connected to the perimeter stage 22 are a number of, preferably several, auxiliary or satellite stages 38. These satellite stages 38 are smaller traditional performance areas built into the outer edge of the perimeter stage 22. Each satellite stage 38 has its own independent lights, a grid and truss system, and also a media surface 44 which may act as a vertical curtain. All of the stage sections are provided with trap doors that allow easy access as well as through a variety of media surfaces. These media surfaces 44 surround the entire perimeter of the perimeter stage 22 and thus surround the entire perimeter of the seating areas 12.

High above the theater floor 172 are several number of grid and truss systems 40 provided above each stage. These grid and truss systems 40 accommodate traditional lighting services as well as multiple elements to facilitate total envelopment of the audience by production and set designs, innovative lighting, the latest laser and hologram technology, pyrotechnics, animatronics and special effects. The grid and truss system 40 just described is supported by a theatrical canopy 42 above the theater floor 172. The grid and truss systems 40 also accommodate side lighting positions 46 as well as motorized hoists 48. Encircling the entire theater area is a projection and control corridor 50. The corridor 50 allows for access by technical personnel as well as live theater actors.

Figure 2:
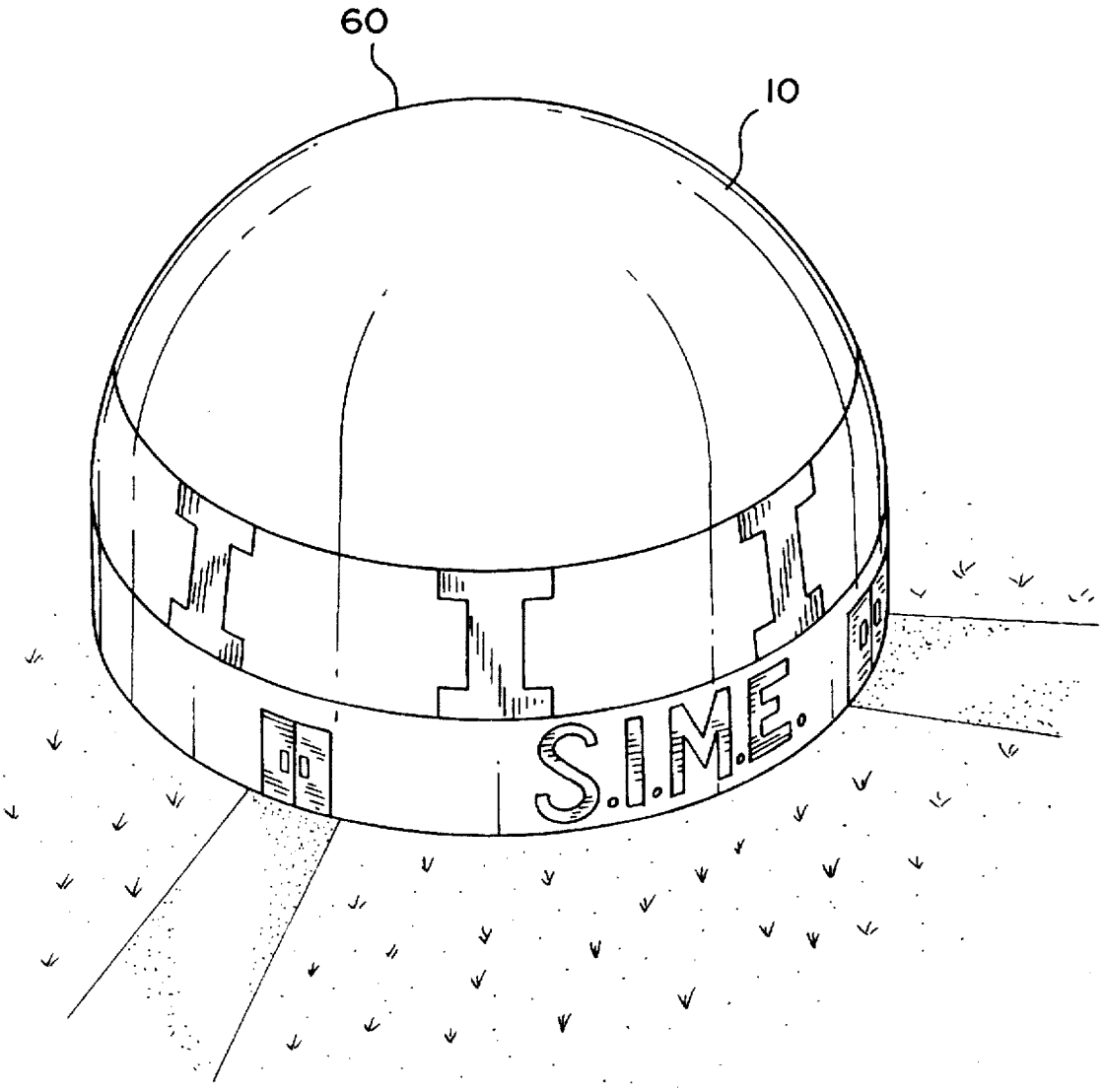
FIG. 2 is a perspective view of the exterior of the theater building of the present invention.

As can be seen is FIG. 2, a perspective view of the exterior theater building 10 is seen. The exterior preferably accommodates a dome shaped roof 60 which is enticing enough to gain the attention of potential theater patrons.

Figure 3:
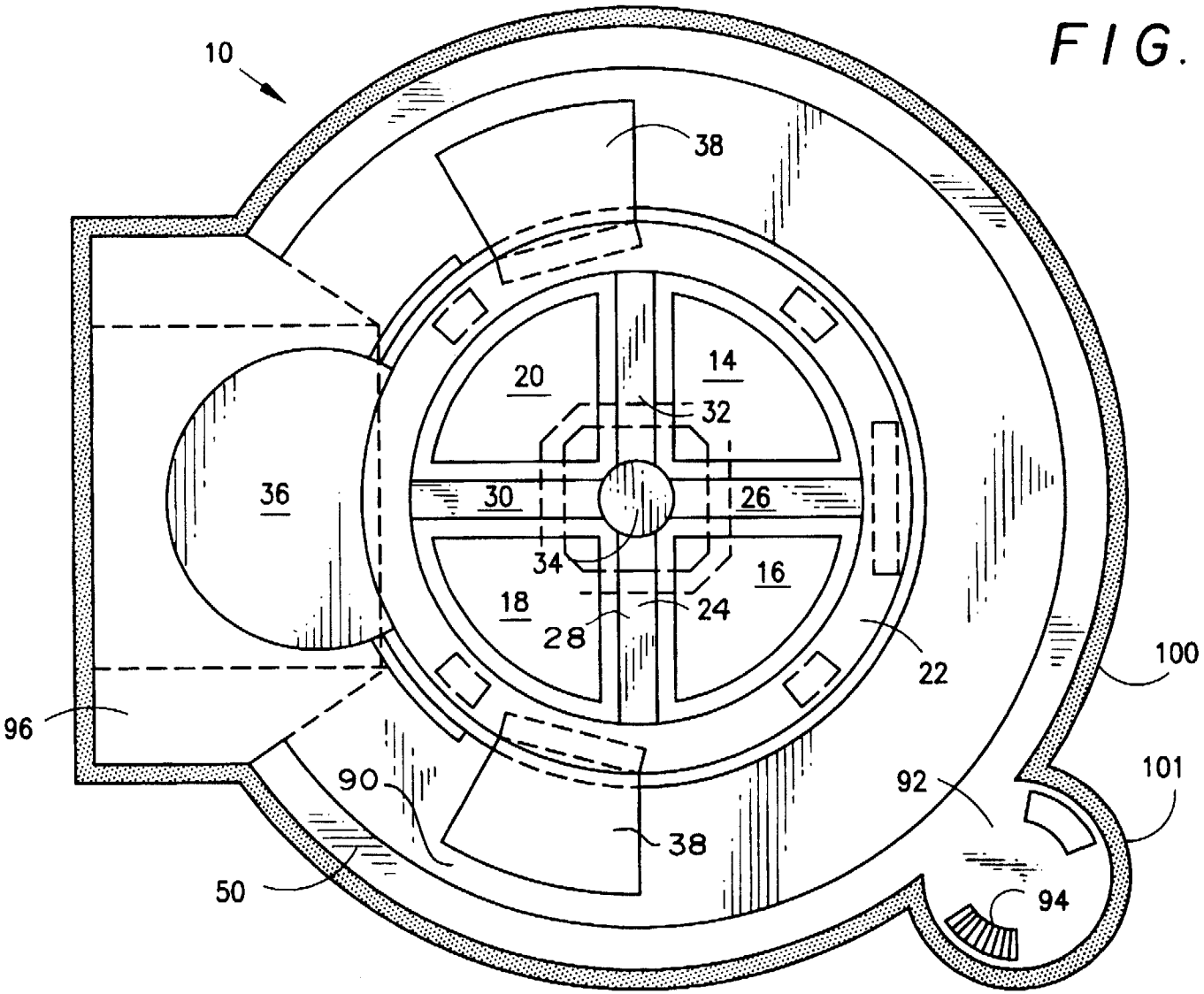
FIG. 3 is a top plan view of the stage and theater floor area of the theater building.

Turning to FIG. 3, a top plan view of the stage and theater floor areas of theater building 10 is shown. In addition to the perimeter stage 22, the hub stage 34, the runner stages 24, the main stage 36, and the auxiliary stages 38, it can be seen that the theater building 10 accommodates several hydraulic tower areas 90. These hydraulic tower areas 90 are used for controlling the theater floor 172 as well as the seats in the seating areas 12. Behind the projection and control corridor 50, it can be seen that a spiral entrance and exit 92 is adjoined to the theater building 10. The exterior wall 100, of the theater building 10, is shown to have a bulbous portion 101, that accommodates the spiral entrance and exit 92. The entrance and exit 92 is provided with several spiral stairways 94 which allow for separate in and out exits. Behind main stage 36, it can be seen that a large rectangular area 96 is provided for accommodating actors and actresses, as well as technical personnel, before their entrance on to one of the stage sections.

Figure 4A:
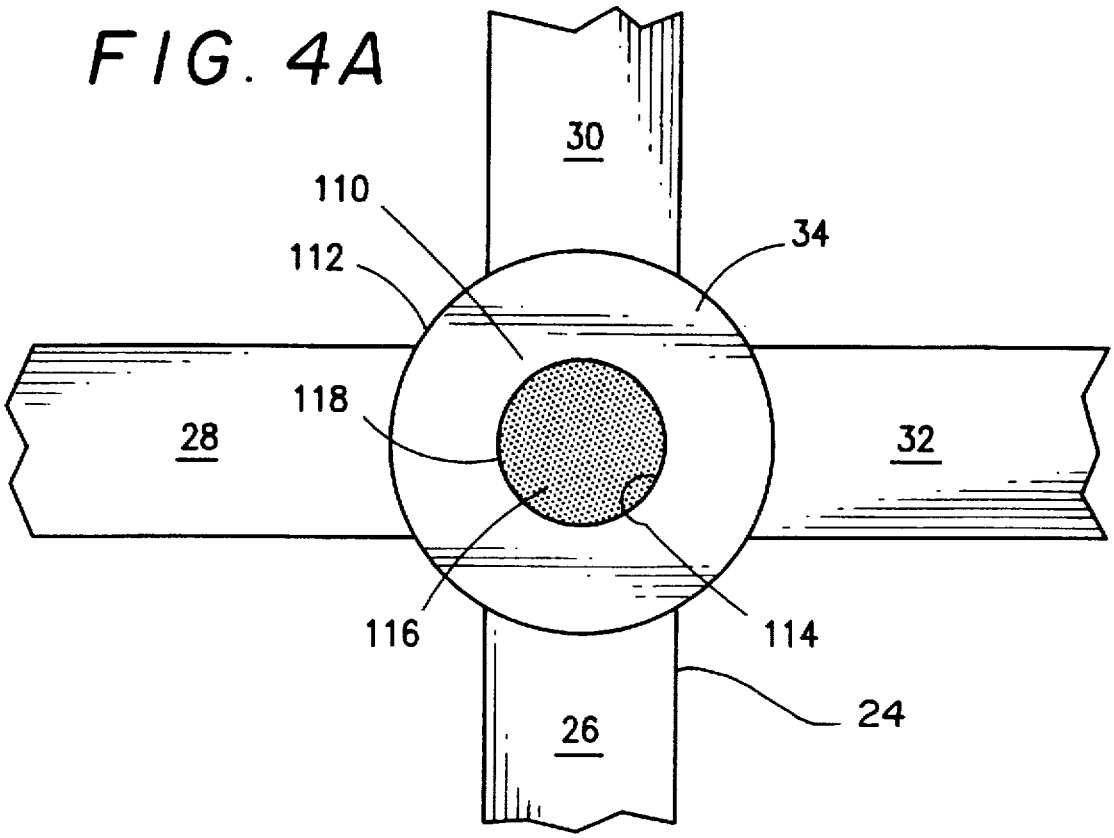
FIGS. 4A and 4B show a top plan view of the inner core and outer ring of the hub stage and a perspective view of the hub stage with the inner core raised above the outer ring.
Figure 4B:
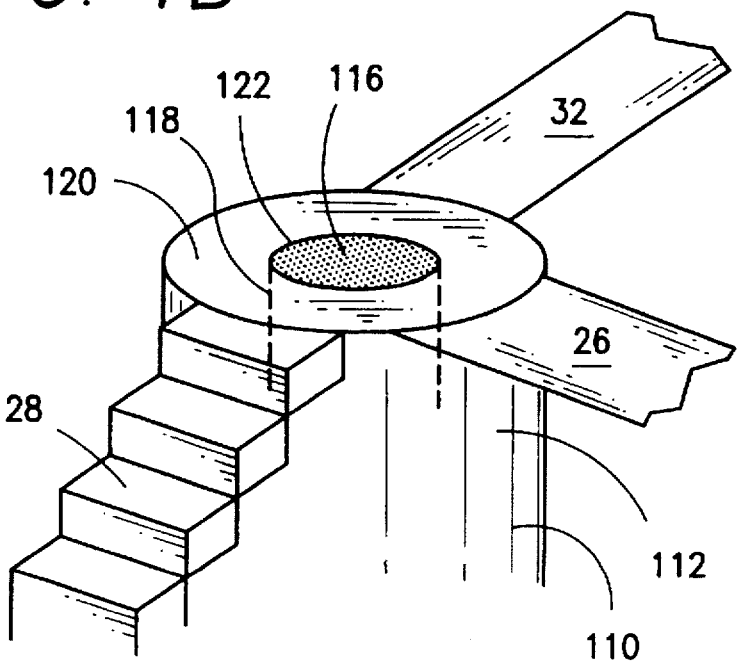

FIGS. 4A and 4B show a preferred embodiment of the hub stage 34. The hub stage 34 preferably has an outer ring 110 and an inner core 116. The outer ring 110 has an outer wall 112 which abuts the runner stages 24 and in inner wall 114 which abuts the inner core 116 at the inner core's outer wall 118. The outer ring 110 and the inner core 116 of the hub stage 34 are independently controlled by hydraulic controls to alter their vertical height with respect each other. As can be seen in FIG. 4*b*, the top surface 122 of the inner core 116 can be positioned above the top surface 120 of the outer ring 110. Of course, the difference in vertical height shown in FIGS. 4B is only exemplary and can be changed as desired. In addition, the inner core 116 could be positioned below the outer ring 110. That is, the top surface 122 of the inner core 116 could be hydraulically controlled so as to sink below the top surface 120 of the outer ring 110. This can be done to provide a dramatic exit for a star performer, or can be done when the lights are not shining on the inner core 116 to provide a secret exit for some of the performers.

Figure 5A:
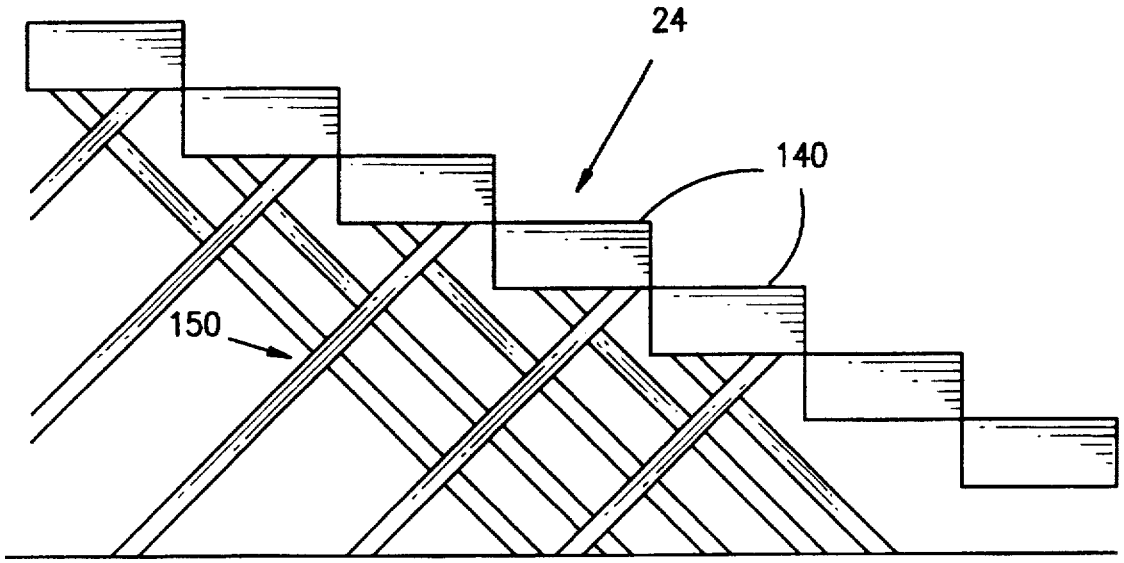
FIGS. 5A and 5B show a side plan view of a runner stage in the tiered position and a side plan view of a runner stage in its planar position.
Figure 5B:
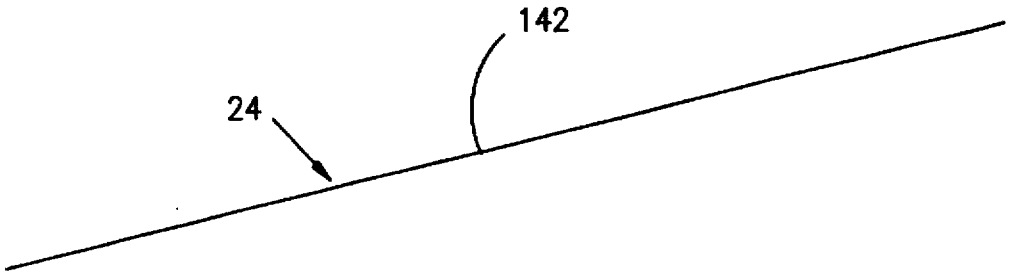

As shown is FIGS. 4*b* and 5*a* and 5*b*, the runner stages 24 can preferably accommodate different positions. For example, as shown in FIG. 4*b* runner stage 28 may be tiered so as to provide steps up to the top surface 120 of the outer ring 110. Alternatively, a runner stage 24 as shown in runner stage 32 may slope upwardly so as to provide a planar running surface from the hub stage 34 to the perimeter stage 22. FIG. 5*a* shows a tiered runner stage 24 that accommodates a number of steps 140. The runner stage 24 is made tiered and stable by a hydraulic system 150. This hydraulic system 150 can turn the same tiered runner stage 24 into a planar runner stage 24 having a planar surface 142 which may be deployed at a wide variety of angles with respect to the horizontal top surfaces of the perimeter stage 22 and hub stage 34.

Figure 6:
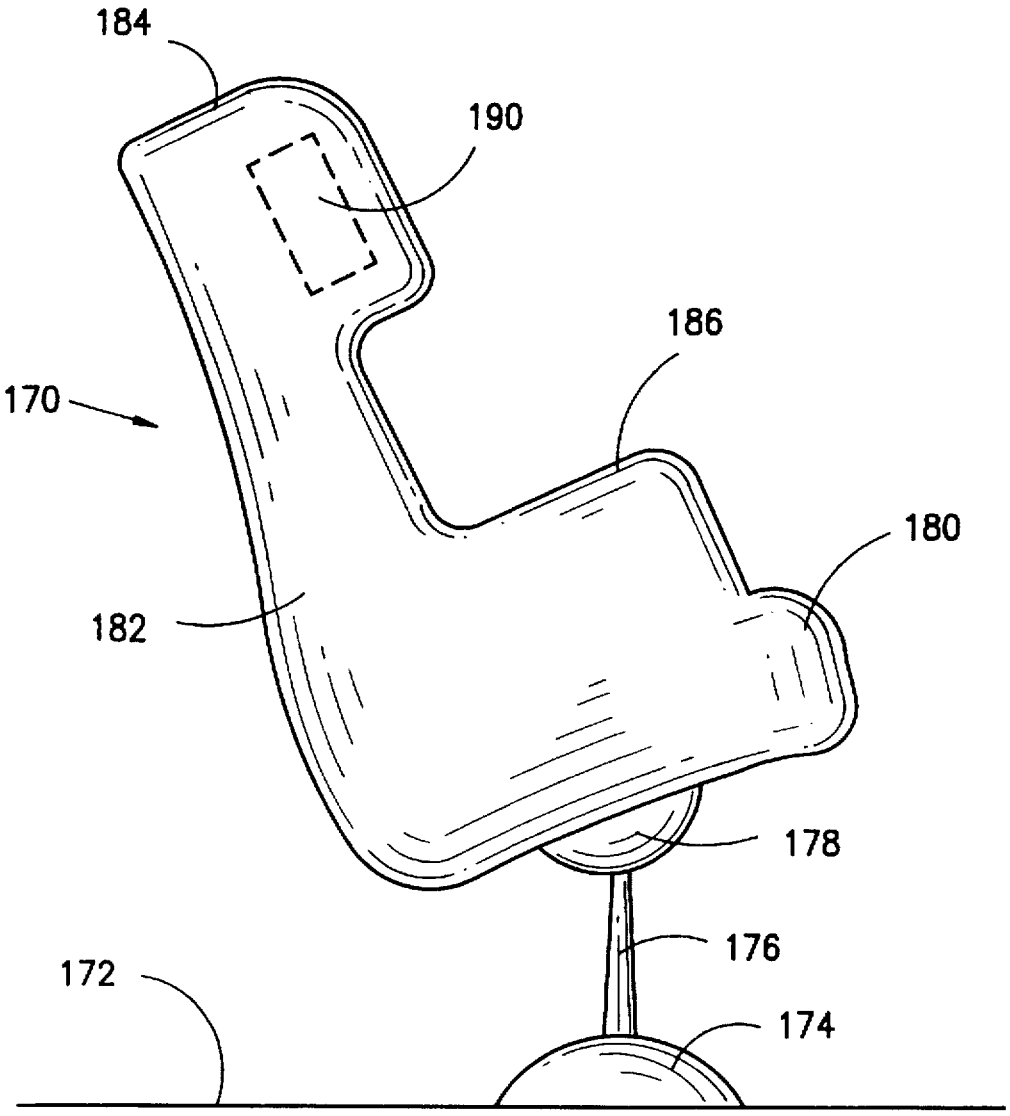
FIG. 6 shows a side view of a seat in the seating area of the theater building of the present invention.

FIG. 6 shows a side view of the seat 170 in one of the seating areas 12. Seat 170 is part of the theater experience of the present invention providing E-Motion Seating™ seats which is the computer controlled rotation of individual seats, movement of specific platforms/sections and the reshaping of the entire audience across the theater floor 172 to maximize performance area and sight lines. Thus, the seats are controlled by a computer located remotely from the sealing area. Additional tactile stimulation and perception enhancements are incorporated into the program to increase the overall experience of the audience. The seats 170 are positioned on theater floor 172. The theater floor 172 is also controlled hydraulically in the same manner as the runner stages 24 are controlled by hydraulic system 150. The seats 170 are fastened to the theater floor by removable and rotatable fastener 174. Stemming from the fastener 174 is a leg 176 connecting the removable fastener 174 to a universal control joint 178. The control joint 178 is attached to the bottom of the seat 170 in a fashion enabling it to rotate and tilt the seat 170 by remote computer control. The seat 170 may accommodate the standard features of a seat cushion 180, a backrest 182, a concave headrest 184, and an arm rest 186. The concave headrest 184 preferably accommodates surround sound speakers 190. Appliances built into the seats 170, arm rests 186 and nearby flooring 172 can create a changing thematic environment complete the sensory experience.

Figure 7A:
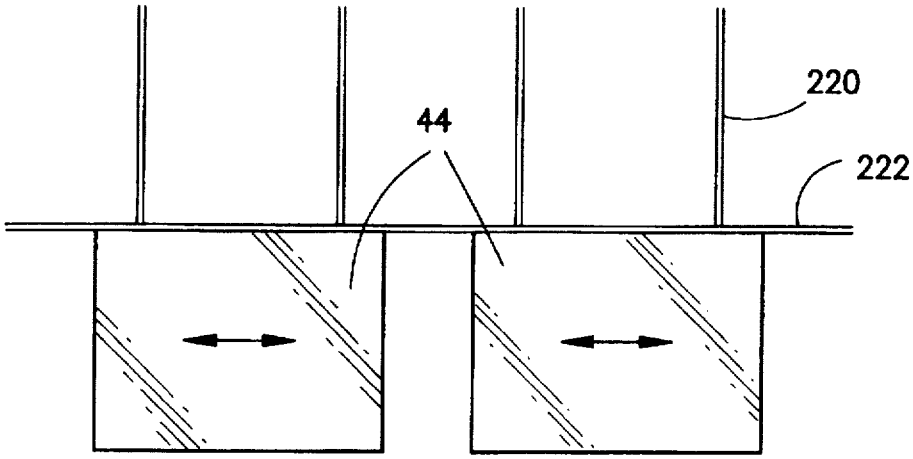
FIGS. 7A–7C show embodiments of media surfaces of the main stage and of an auxiliary stage wherein the media surfaces are in a partially open position, and a top view of one embodiment of media surfaces for a perimeter stage wherein the media surfaces are in an overlapping position.
Figure 7B:
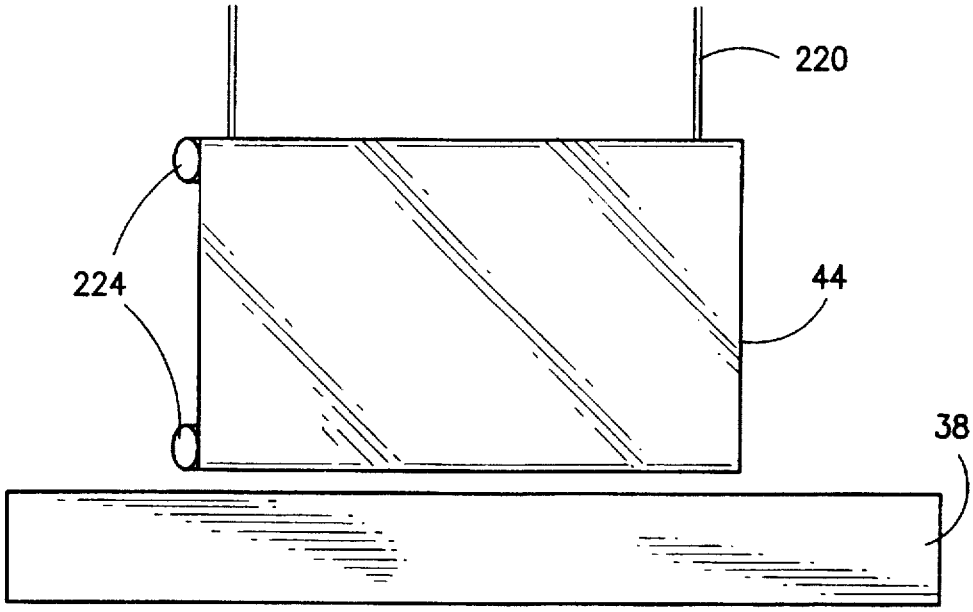
Figure 7C:
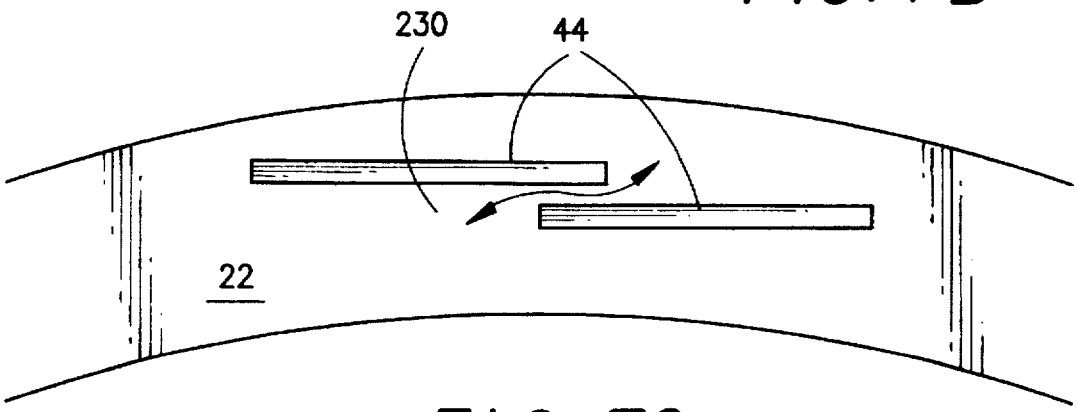

FIGS. 7*a*–7*c* show details of media surfaces 44. These media surfaces 44 are versatile, multipurpose projection surfaces that are permeable and elastic. Media surfaces 44 provide backstage entrances and exits, set design canvases, transition devices and special effects mediums as well as front/rear projection screens. Housed upon rollers on the top and bottom of each screen area, media surfaces 44 can wind or rewind automatically to a specific surface for a desired effect at any point in the show while maintaining a traditional projection surface. As shown in FIG. 7*a*, media surfaces 44 for main stage 36 are also provided on runner cords 222 and hang on pull cords 220. Thus the media surfaces 44 for the main stage 36 can open and close horizontally or vertically as typical stage curtains. As show in FIG. 7*b*, each auxiliary stage 38 is preferably provided with a media surface 44 which is donned on rollers 224 which enables media surfaces 44 to be lifted as a vertical curtain or moved up or down to show a different surface. FIG. 7*c* shows one embodiment of a top view of media surfaces 44 for a section of perimeter stage 22. The media surfaces 44 can be slightly overlapped providing an overlapping space 230 for the entrance and exit of live performers. Because the media surfaces 44 overlap they do not interrupt the continuity of any cinematic performance displayed on the surfaces 44. The media surfaces described provide for the combination of live action theater and 360° film projection using innovative media surfaces 44 for a seamless transition between reality and fantasy to create an unparalleled performance environment. Action can occur on any of the stage performance areas with visual embellishments or ambiance projected onto the remaining media surfaces that encircle the audience. Action occurring within the production can also appear as film projected on to the multiply media surfaces allowing for a true 360° audience perspective. Further transitions can occur with live actors literally stepping through media surfaces and entering the celluloid domain to take advantage of established cinema effects and camera techniques.

Specifically, the ideal dimensions of a theater according to the preferred embodiment of the present invention are as follows. The entire theater building square footage shall be in the approximate range of 12,000 square feet with 100–120 ft. diameter area assumed for audience, hub stage, and runners. Preferably the perimeter stage is 12 ft wide and circles the entire circumference of the theater interior. Each of the four audience sections seats approximately 300 people for a total of an approximate range of 1200 available seats.

The central hub stage is preferably 15 ft in diameter and each of the four runners is preferably 8 feet wide. The audience floor can be raised or lowered a total of approximately 9 feet depending on the location of a specific platform. The outer stage ring, which encircles the perimeter stage and includes the main stage and auxiliariary stages, is 30 ft wide. Also included in the audience seating/performance core area may be a passenger elevator for handicap access, a performer circulation ring preferably 6 ft wide which would be outside the outer stage ring (i.e., the control corridor 50), and several booths including a lighting control booth, sound control booth, effects booth, and a plurality of followspot booths, each booth accommodating approximately 100 to 500 sq. ft apiece. Thus, the total square feet covered by the audience seating/performance core area is approximately 52,000 which preferably includes a three tiered audience circulation ring, not shown in the drawings, for egress at any level.

The theater building 10 of the present invention also preferably comprises front-of-house and public spaces such as four ticket windows, a manager's office, a vault, an accountant work area, supplies and record storage for the box office, unisex rest room for the box office, a box office break room, a waiting/holding area, a coat room, concession areas distributed around the waiting area, a concession storage/work room, male and female public rest rooms, a front of house storage room, a house managers office/first aide room, and an ushers locker room. Combined, these front of house and public spaces may accommodate approximately 10,110 net square feet. The back stage and support spaces of the theater building 10 may preferably include a plurality of star dressing rooms with toilets and showers, a plurality of principal dressing rooms with toilets and showers, a plurality of multiperson dressing rooms with toilets and showers, a performers' lounge with kitchenette, a wardrobe room, a laundry and wardrobe maintenance room, a dimmer room, an audio rack room, a motor control rack room, a special effects rack room, a technical supervisor's office, a crew locker room with toilets and showers, a stage door lobby and security office, a loading dock with two truck bays, a building engineering office, a janitorial staff office, lighting storage, audio storage, general storage, a maintenance and repair area, vending machines and pay phones, backstage rest rooms, and a freight elevator. Combined these backstage and support spaces will accommodate approximately 8,000 to 10,000 net square feet The theater building 10 preferably should further accommodate the following administrative offices: an office suite, a reception/secretarial area, a copy area, a room for storage and supplies, rest rooms, and a break room with kitchenette.

In total, the theater building 10 including the audience seating and performance core, the front of house and public spaces, the backstage and support spaces and administrative spaces will take an approximate range of 90,000 to 110,000 gross square feet which includes non-programmed spaces such as service areas, mechanical and electrical spaces, inaccessible spaces, and circulation.

Although the invention has been shown and described with respect to an preferred embodiment thereof, it would be understood by those skilled in the art that other various changes, omissions, and additions thereto may be made without departing from the spirit and scope of the present invention. In general, the invention is only intended to be limited by the scope of the following claims.

We claim:

1. In a building for theatrical, cinematic, and other performances, an interactive multimedia entertainment theater comprising in combination:

rotatable seats in a seating area which are controlled remotely by computer;

a hydraulically controlled theater floor for supporting the seats;

a plurality of stage sections having at least a perimeter stage which encircles the seating area, and a hub stage in the center of the seating area, wherein the hub stage is comprised of an inner circular core and an outer annular ring that each have independent access and hydraulic control for height and rotation and all stage sections are positionable above the seating area; and, front/rear projection media surfaces surrounding and above substantially the entire perimeter stage cooperating with means for projecting film on the surfaces.

2. The interactive multimedia entertainment theater of claim 1 wherein the plurality of stage sections further comprises a plurality of runner stages connecting the hub stage to the perimeter stage.

3. The interactive multimedia entertainment theater of claim 2 wherein the plurality of stage sections further comprises a main stage and at least one satellite stage built off of the perimeter stage.

4. The interactive multimedia entertainment theater of claim 2 wherein the runner stages are hydraulically controlled to alternate between a first condition in which the runner stages are tiered and a second condition in which the runner stages are planar and deployable at one of a variety of angles relative to a top surface of the hub stage.

5. The interactive multimedia entertainment theater of claim 2 comprising four runner stages which divide the seating area into quadrants and wherein seats located in the same quadrant are rotated simultaneously.

6. The interactive multimedia entertainment theater of claim 1 wherein each of the rotatable seats are provided with surround sound speakers built into headrests of the seats.

7. The interactive multimedia entertainment theater of claim 6 wherein each of the rotatable seats are provided with built-in physical response generators and appliances.

8. The interactive multimedia entertainment theater of claim 1 wherein the hydraulically controlled theater floor for supporting the seats is a tiered floor having tiers separately movable in a vertical direction.

9. The interactive multimedia entertainment theater of claim 1 further comprising in combination a theatrical canopy over the seating area which accommodates at least one grid and truss system.

10. The interactive multimedia entertainment theater of claim 1 wherein the media surfaces are housed upon rollers at the top and bottom of each surface whereby the surfaces are adapted to wind or rewind automatically to a specific surface while maintaining a traditional projection surface.

11. The interactive multimedia entertainment theater of claim 1 wherein the plurality of stage sections further comprises a plurality of satellite stages extending outwardly from an outer edge of the perimeter stage and coplanar with the perimeter stage.

12. The interactive multimedia entertainment theater of claim 11 wherein the media surfaces in front of the plurality of satellite stages overlap to produce overlapping spaces that provide spaces for stage entrances and exits back and forth between the satellite stages and the perimeter stage without disturbing the continuity of the viewable projection area.

13. The interactive multimedia entertainment theater of claim 1 wherein a central control means is provided to control the temperature, humidity, wind, condensation, and smell of the atmosphere inside the theater.

14. The interactive multimedia entertainment theater of claim 1 wherein the inner core can assume a variety of vertical positions relative to a top surface of the outer ring including a first position above the top surface of the outer ring and a second position below the top surface of the outer ring, wherein the inner core is usable as an exit for performers in the second position.

15. A floor and stage area for a theater comprising:

a theater floor adapted to accommodate a seating area;

a main stage;

a perimeter stage surrounding the floor;

at least one satellite stage built into the perimeter stage and larger in at least one dimension than the perimeter stage;

a hub stage located in the center of the theater floor; and, a plurality of runner stages connecting the hub stage to the perimeter stage and dividing the theater floor into an equal number of sections, wherein the runner stages are hydraulically controlled to alternate between a first condition in which the runner stages are tiered and a second condition in which the runner stages are planar and deployable at one of a variety of angles relative to a top surface of the hub stage;

wherein all stages are located vertically above the theater floor.

16. The floor and stage area for a theater as claimed in claim 15 wherein the hub stage is comprised of an inner core and an outer ring that each have independent access and hydraulic control for height and rotation.

17. The floor and stage area for a theater as claimed in claim 15 wherein the theater floor is hydraulically controlled and wherein the hydraulic control for the hub stage and the hydraulic control for the theater floor are provided by hydraulic towers.

18. The interactive multimedia entertainment theater of claim 16 wherein the inner core can assume a variety of vertical positions relative to a top surface of the outer ring including a first position above the top surface of the outer ring and a second position below the top surface of the outer ring, wherein the inner core is usable as an exit for performers in the second position.

19. In a building for theatrical, cinematic, and other performances, an interactive multimedia entertainment theater comprising in combination:

rotatable seats in a seating area which are controlled remotely by computer, wherein each of the seats are provided with surround sound speakers built into headrests of the seats, and wherein each of the seats are provided with built-in physical response generators and appliances;

a hydraulically controlled theater floor for supporting the seats wherein the floor is a tiered floor which is movable in a vertical direction;

a plurality of stage sections comprising a perimeter stage which encircles the seating area, a hub stage in the center of the seating area, a plurality of runner stages connecting the hub stage to the perimeter stage, and a main stage and at least one satellite stage built off of the perimeter stage, wherein the hub stage is comprised of an inner core and an outer ring that each have independent access and hydraulic control for height and rotation and wherein all stage sections are positionable above the seating area and wherein trap doors are provided in the stages to provide access to the stages;

a theatrical canopy over the seating area which accommodates a grid and truss system; and, a film projection media surface surrounding and above substantially the entire perimeter stage and equipped with means for projecting film, wherein media surfaces in front of the at least one satellite stage overlap to produce overlapping spaces that provide spaces for stage entrances and exits back and forth between the at least one satellite stage and the perimeter stage without disturbing the continuity of the viewable projection area.

20. The interactive multimedia entertainment theater of claim 19 wherein the runner stages are hydraulically controlled to alternate between a first condition in which the runner stages are tiered and a second condition in which the runner stages are planar and deployable at one of a variety of angles relative to a top surface of the hub stage.

* * * * *